US005118310A

United States Patent [19]

Stroede et al.

[11] Patent Number: 5,118,310

[45] Date of Patent: Jun. 2, 1992

[54] CENTRAL LATCH MODULAR TELEPHONE CONNECTOR

[75] Inventors: Andrew J. Stroede, Mokena; Jack E. Caveney, Hinsdale, both of Ill.

[73] Assignee: Panduit Corp., Tinley Park, Ill.

[21] Appl. No.: 665,625

[22] Filed: Mar. 6, 1991

[51] Int. Cl.[5] ..... H01R 23/02

[52] U.S. Cl. ..... 439/676; 439/405

[58] Field of Search ..... 439/695, 696, 701, 686, 439/676, 395-401, 417-419, 404, 405, 407

[56] References Cited

U.S. PATENT DOCUMENTS

| | | | |
|---|---|---|---|
| 3,824,530 | 6/1974 | Roberts et al. . | |
| 4,083,615 | 4/1978 | Volinskie . | |
| 4,261,633 | 4/1981 | Abernethy . | |
| 4,435,034 | 3/1984 | Aujla et al. . | |
| 4,488,768 | 12/1984 | Sigmon . | |
| 4,496,206 | 1/1985 | Markwardt et al. . | |
| 4,508,411 | 4/1985 | Hughes et al. . | |
| 4,545,635 | 10/1985 | Bunnell . | |
| 4,606,595 | 8/1986 | Dola . | |
| 4,641,901 | 2/1987 | Brennan et al. . | |
| 4,648,678 | 3/1987 | Archer . | |
| 4,657,330 | 4/1987 | Levy . | |
| 4,708,414 | 11/1987 | Lam . | |
| 4,737,113 | 4/1988 | Hopper et al. . | |
| 4,738,635 | 4/1988 | Harrington et al. . | |
| 4,854,892 | 8/1989 | Vignoli . | |
| 4,875,881 | 10/1989 | Caveney et al. . | |
| 4,895,532 | 1/1990 | Bogese, II . | |
| 4,909,753 | 3/1990 | Siemon et al. . | |
| 4,917,629 | 4/1990 | Matsuzaki et al. | 439/405 |
| 4,975,078 | 12/1990 | Stroede et al. . | |

OTHER PUBLICATIONS

Installation instruction page for an AT&T modular plug (700A8).

*Primary Examiner*—David L. Pirlot

*Attorney, Agent, or Firm*—Charles R. Wentzel; Mark D. Hilliard

[57] ABSTRACT

A modular telephone connector includes a housing defining a standard telephone jack, a contact carrier that mounts a plurality of metal contacts each having resilient cantilever jack forming portions and insulation displacement portions and a wire positioning fixture having aligned first and second rows of wire guide channels. The connector is assembled by latching the contact carrier and contacts to the housing, positioning wires through first and second wire guide channels of the wire positioning fixture and securing the fixture to the housing and contact carrier with a centrally located cantilever latch arm formed on the fixture inwardly from the periphery of the connector, closely adjacent the row of contacts. The latch arm engages a slot formed in the housing and contact carrier to releasably secure the fixture to the connector. The central latch arm prevents misalignment of the fixture with the housing and contact carrier which can result in defective termination of the connector.

16 Claims, 5 Drawing Sheets

CENTRAL LATCH MODULAR TELEPHONE CONNECTOR

TECHNICAL FIELD

The present invention relates to modular telephone connectors and specifically to a modular telephone jack having insulation displacement contacts allowing manual termination of the connector to individual wires of a telephone cable in the field without the use of special termination tools.

BACKGROUND ART

Many different designs of field installable modular telephone connectors have been proposed. The desirable characteristics of a field installable telephone connector include a minimal size, ease of assembly and reliable termination of the connector to telephone wires.

Modular telephone connectors typically include a plurality of interlocking parts including a housing that defines a standard telephone jack, a contact carrier that carries and positions a plurality of insulation displacement contacts for termination to a plurality of wires and a wire positioning fixture that positions individual wires for termination within each respective insulation displacement contact. The housing and contact carrier can be formed integrally but are usually manufactured separately and preassembled to form a housing/wire carrier unit that presents the insulation displacement contacts for receipt of the telephone wires when the wire positioning fixture is assembled to the housing and contact carrier.

The wire positioning fixture is typically secured to the housing/wire carrier by peripheral latching structural features that cooperate with structural features formed on the housing/ contact carrier. See FIG. 3 of U.S. Pat. No. 4,657,332 to Levy. Connectors that utilize a plurality of peripherally disposed latching structural features to secure the wire positioning fixture to the housing/contact carrier, if both latching features of the fixture are not carefully brought into engagement concurrently with corresponding latching features of the housing resulting, can be misaligned during assembly resulting in a faulty termination of the wires to the contacts.

An additional problem caused by faulty assembly of certain multipart modular telephone connectors is the possibility of a short between the distal end of a terminated wire and an adjacent telephone jack contact resulting in a defective connector termination.

The known field installable telephone connectors have not eliminated the chance of defective termination due to improper assembly of field installable telephone connectors and thus leave room for improvement in the art.

DISCLOSURE OF THE INVENTION

It is an object of the present invention to provide an improved modular telephone connector of minimal size that allows rapid and easy positioning of a plurality of telephone wires and manipulation of the connector parts to simultaneously terminate the wires in the field without the use of special assembly tools.

It is another object of the present invention to provide an improved modular telephone connector that eliminates the possibility of defective termination due to improper assembly of the connector.

These and other objects, together with the advantages thereof over existing prior art forms, which will become apparent from the following specification or accomplished by means hereinafter described.

In general, a modular telephone connector adapted for termination of a plurality of telephone wires includes a housing adapted to mate with a standard telephone connector; a plurality of metal contacts each having a first portion adapted to conductively engage corresponding terminals of the standard telephone connector and an insulation displacement portion adapted to terminate one of the telephone wires; contact carrier means for mounting the contacts to the housing with the insulation displacement portions disposed outwardly of the housing arranged in a contact row on an upper surface of the contact carrier means; fixture means for positioning the wires with respect to the insulation displacement portions, the fixture means including a plurality of wire guide channels formed in a row on an inner surface of the fixture means; and central latch means for securing the fixture means to the housing and contact carrier, the central latch means being disposed inwardly from the periphery of the connector.

PREFERRED EMBODIMENTS FOR CARRYING OUT THE INVENTION

Figure 1:
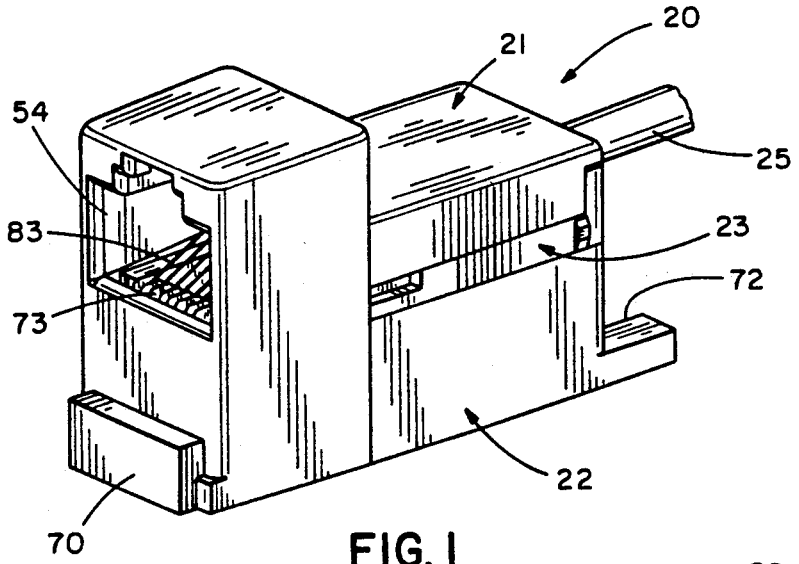
FIG. 1 is an isometric view of an assembled modular telephone connector terminated to a telephone cable embodying the concept of the present invention.

A modular telephone connector embodying the concept of the present invention is designated generally by the numeral 20 in the accompanying drawings. Connector 20 includes a wire positioning fixture 21, a housing 22, a contact carrier 23 and a plurality of metal contacts 24. Housing 22 and contact carrier 23 are preferably each integrally molded of ABS plastic. Fixture 21 is preferably integrally molded of transparent polycarbonate plastic to facilitate placement of wires in the fixture.

Connector 20 is utilized to terminate a standard telephone cable 25 having eight single conductor insulated telephone wires 26.

As best seen in FIGS. 2–4, and 11, wire positioning fixture 21 includes an inner surface 28, an outer surface 29, side walls 30 and a cantilever central resilient latch arm 31 medially disposed inwardly from the periphery of the connector 20. Latch arm 31 is integrally formed on the inner surface 28 of the fixture 21, projecting at a substantially perpendicular angle from the plane of entry bridge 39 on the inner surface 28 of fixture 21. Disposed at the distal end of the latch arm 31 is a locking barb 32 seen in FIG. 3.

Formed on either side of latch arm 31 are key columns 34 which are disposed inwardly from the periphery of the connector. Key columns 34 have an L shaped cross section configured to accurately engage structural features in housing 22 during assembly. See FIGS. 8 and 11.

Eight rectangular wire guide channels 35 are formed on inner surface 28 of wire positioning fixture 21 by seven parallel entry walls 37 formed perpendicular to inner surface 28 and entry bridge 39 connecting the distal edges of side walls 30 and the distal edges of entry walls 37. See FIGS. 4 and 11. The rectangular section of each wire guide channel 35 is chosen to minimize the surface contact between a cylindrical wire and channel 35, thus, facilitating the ease of insertion of each wire 26 through each channel 35.

Figure 3:
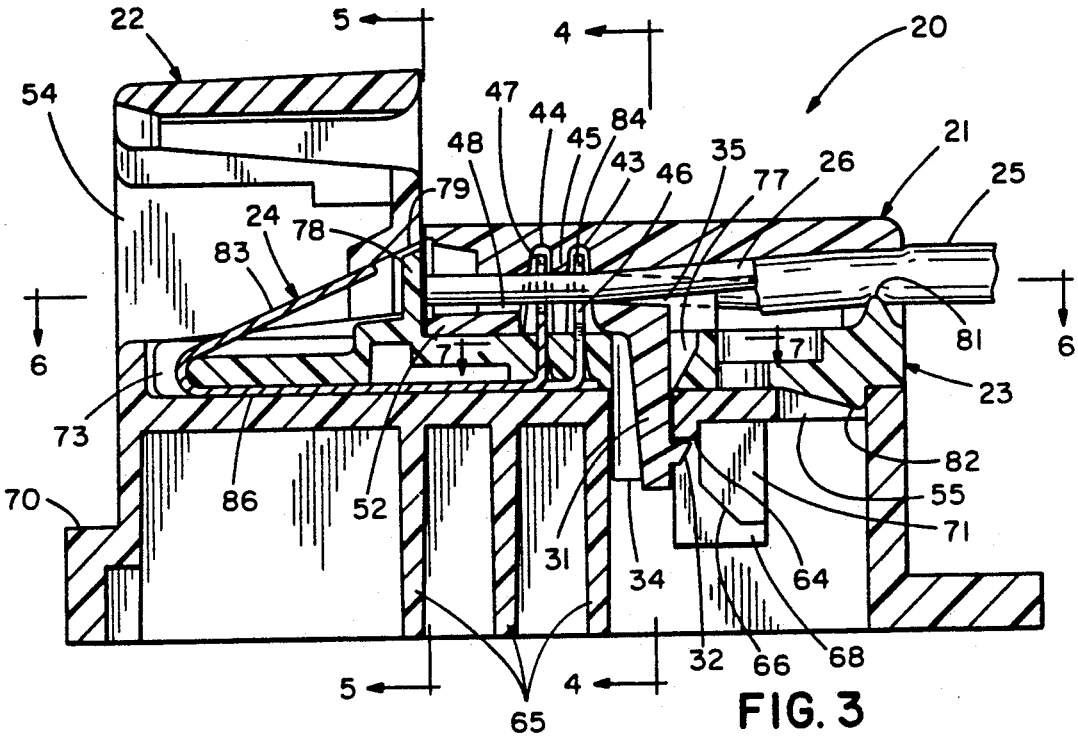
FIG. 3 is a sectional view of the connector of FIG. 1.
Figure 4:
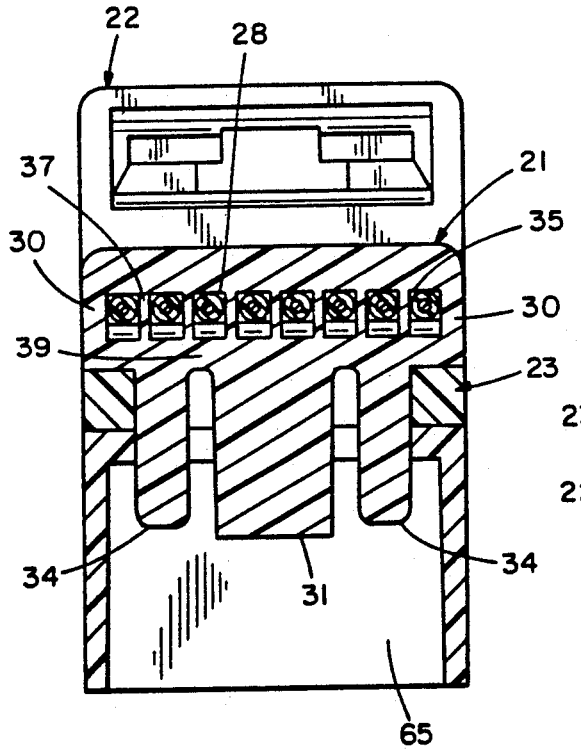
FIG. 4 is a sectional view taken along line 4—4 of FIG. 3.
Figure 11:
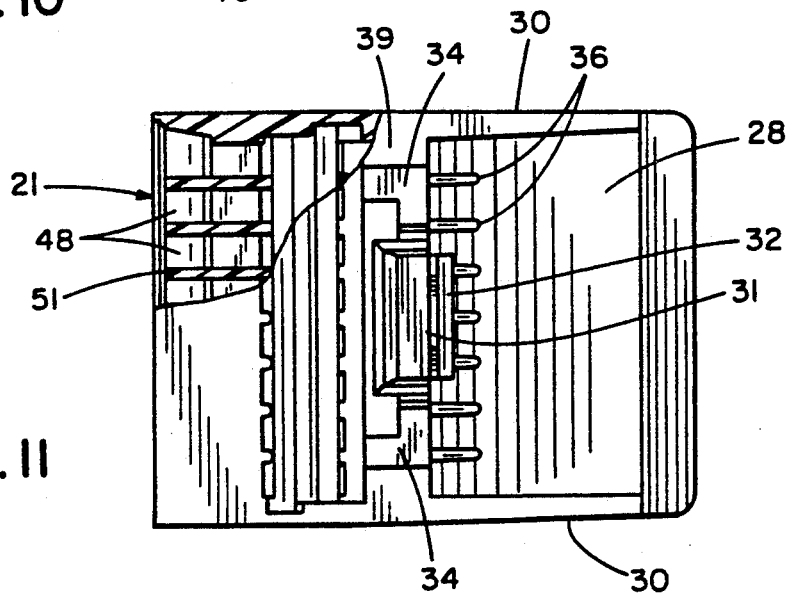
FIG. 11 is a bottom view of the wire positioning fixture of the connector of FIG. 1.
Figure 12:
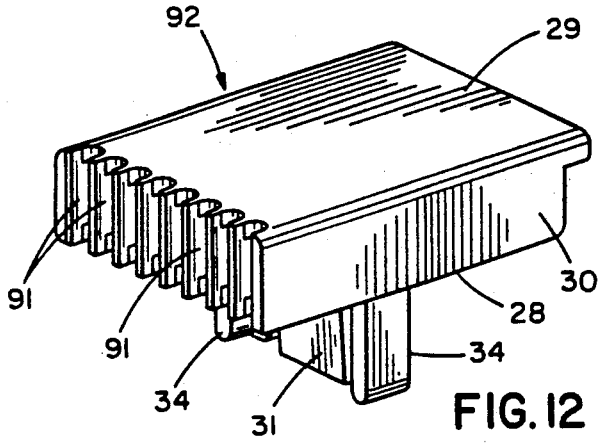
FIG. 12 is an isometric view of a second embodiment of a daisy chain wire positioning fixture that can be assembled with the housing, contact carrier and contacts of the modular telephone connector of FIGS. 1-10 to form a daisy chain modular telephone connector.
Figure 13:
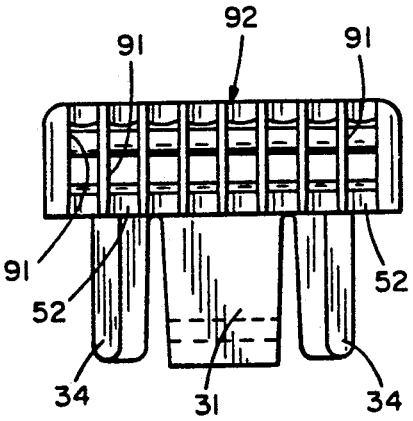
FIG. 13 is a front view of the daisy chain wire positioning fixture of FIG. 12.
Figure 14:
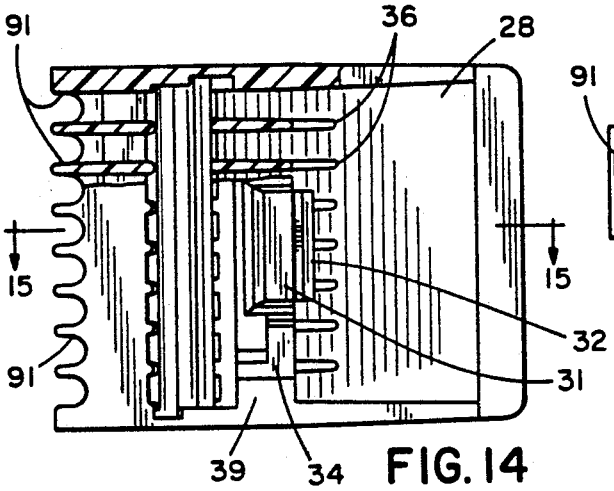
FIG. 14 is a bottom view partially in section of the daisy chain wire positioning fixture of FIG. 13.
Figure 15:
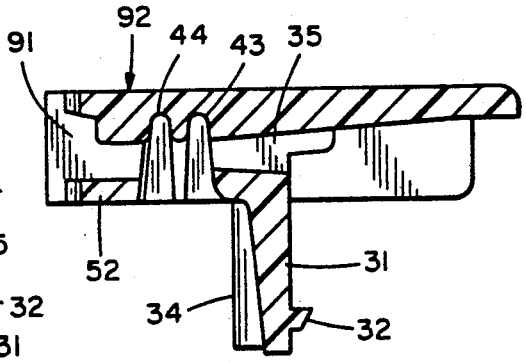
FIG. 15 is a sectional view taken along line 15—15 of FIG. 14.
Figure 16:
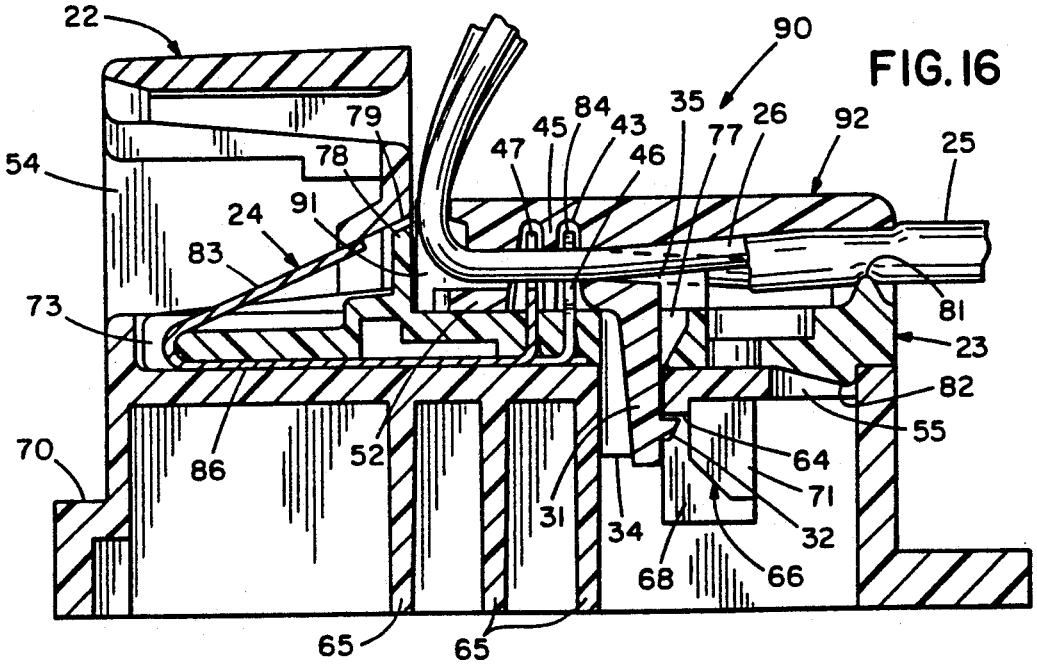
FIG. 16 is a sectional view of the assembled daisy chain modular telephone connector.

As best seen in FIG. 3, the height of each wire guide channel 35 tapers from a height of approximately 1¼ times the diameter of wire 26 between the entry edge of entry bridge 39 and inner surface 28 to slightly greater than the diameter of wire 26 between the exit edge of entry bridge 39 and the inner surface 28. The tapered channels 35 facilitate insertion of wires 26 into channels 35 while accurately positioning each wire 26 as it exits channel 35. As seen in FIG. 11, a plurality of partition walls 36 which are approximately one half the height of entry walls 37 pre-align each wire as it is inserted into each wire guide channel 35.

Disposed perpendicular to the wire guide channels 35 are parallel first and second contact slots 43 and 4 which define therebetween a wire anvil 45. As seen in FIG. 3, first and second contact slots 43 and 44 are disposed to respectively receive a rearward row 46 or a forward row 47 of the termination ends of contacts 24 positioned on the upper surface of contact carrier 23. Wire anvil 45 is disposed to engage the portion of each wire 26 positioned between forward and rearward contact rows 46 and 47 to force each wire into conductive engagement with each insulation displacement slot formed in the distal end of the termination end of each contact 24. Wire anvil 45 has a rounded contour with its distal edge being in alignment with the portions of fixture 21 on either side of anvil 45, which each respectively define the upper surfaces of wire guide channels 35 and 48. Thus, a wire inserted through guide channel 35 is unable to snag against wire anvil 45.

Figure 2:
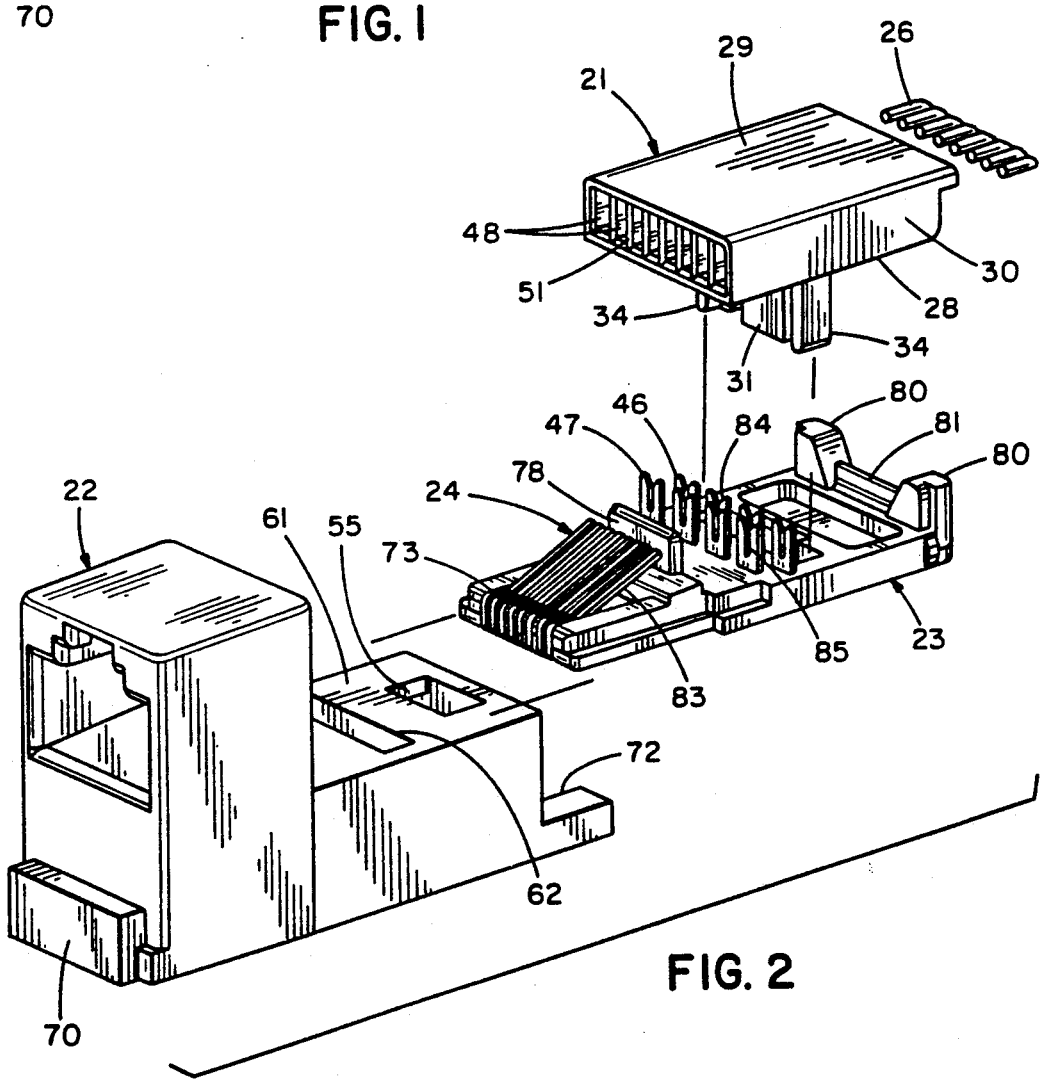
FIG. 2 is an exploded isometric view of the connector of FIG. 1.

As seen in FIGS. 2 and 3, eight rectangular second wire guide channels 48 are respectively formed in alignment with each of the wire guide channels 35 the inner surface of fixture 29 by seven parallel exit walls 51 formed perpendicular to the inner surface of fixture 29 and an exit bridge 52 connecting the distal edges of side walls 30 and exit walls 51. As best seen in FIG. 3, the height of each second wire guide channel 48 is approximately 1½ times the diameter of wire 26 with an inner exit bridge surface of exit bridge 52 being disposed at a point below the exit edge of entry bridge 39 defining a larger opening for second wire guide channels 48 relative to wire guide channels 35 to insure ease of entry of a wire 26 into a second wire guide channel 48 from an aligned wire guide channel 35. An alternative embodiment of the present invention can be constructed by forming fixture 21, as shown in FIG. 3, without exit bridge 52, with adjacent exit walls 51 defining wire positioning slots which laterally position each respective wire therein.

Figure 5:
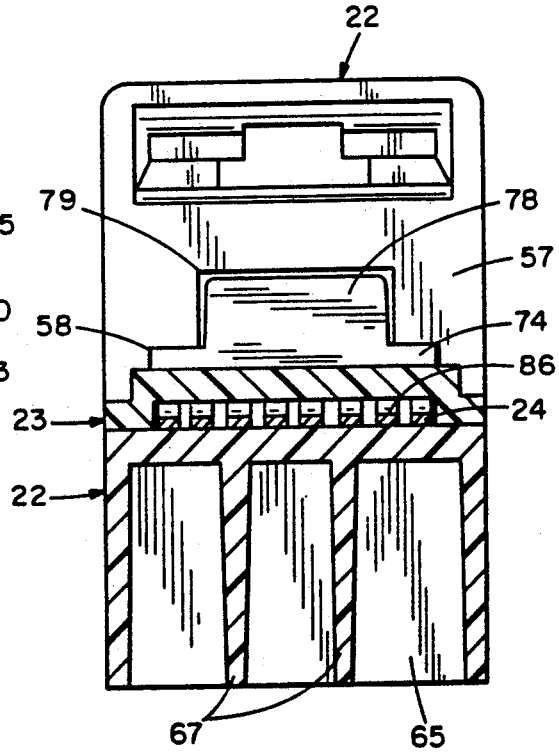
FIG. 5 is a sectional view taken along line 5—5 of FIG. 3.
Figure 6:
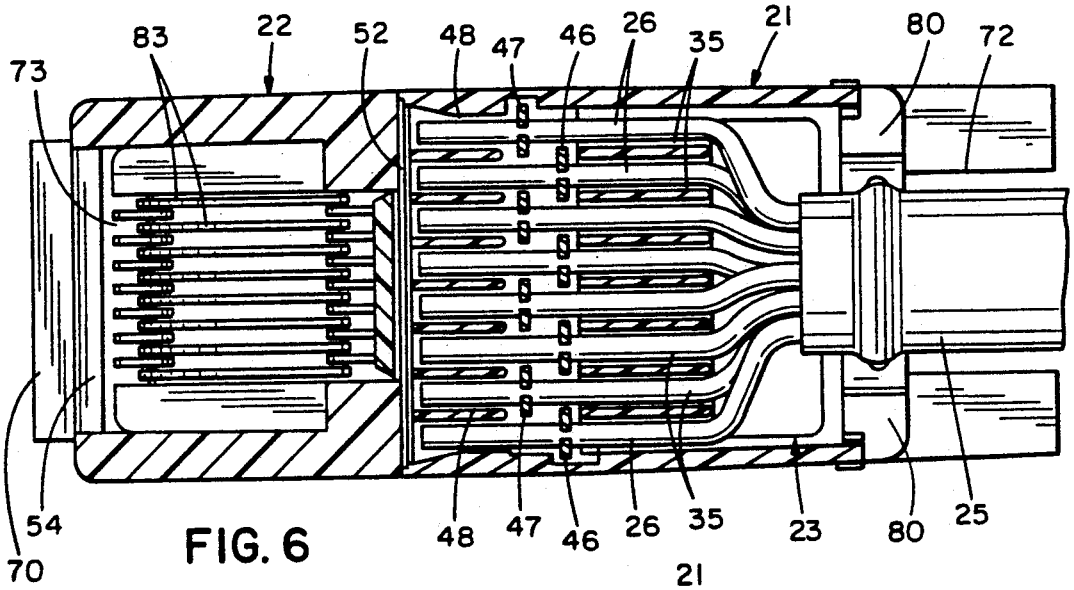
FIG. 6 is a sectional view taken along line 6—6 of FIG. 3.
Figure 7:
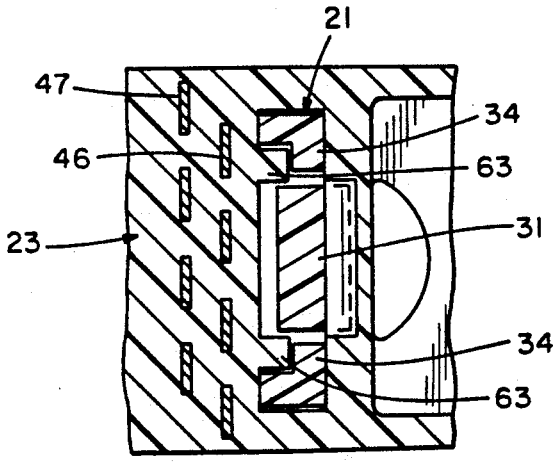
FIG. 7 is a sectional view taken along line 7—7 of FIG. 3.

A jack housing 22 includes a jack socket 54 (see FIG. 1) of a standard configuration for accepting a standard modular telephone plug. Socket 54 includes a back wall 57, seen in FIG. 5, that defines a stepped profile slot 58 shaped to accurately accept and center contact carrier 23. As seen in FIG. 2, housing 22 includes a carrier positioning surface 61 having a housing alignment slot 62, and a carrier latch aperture 55.

Housing alignment slot 62 is configured to accept central latch 31 and key columns 34 to provide accurate fine alignment of fixture 21 and housing 22 during assembly. As shown in FIG. 3, a reinforcing ridge 64 is formed at a rearward, bottom edge of slot 62 and is engaged by locking barb 32 of resilient central latch 31 to lock fixture 21 to housing 22.

Figure 8:
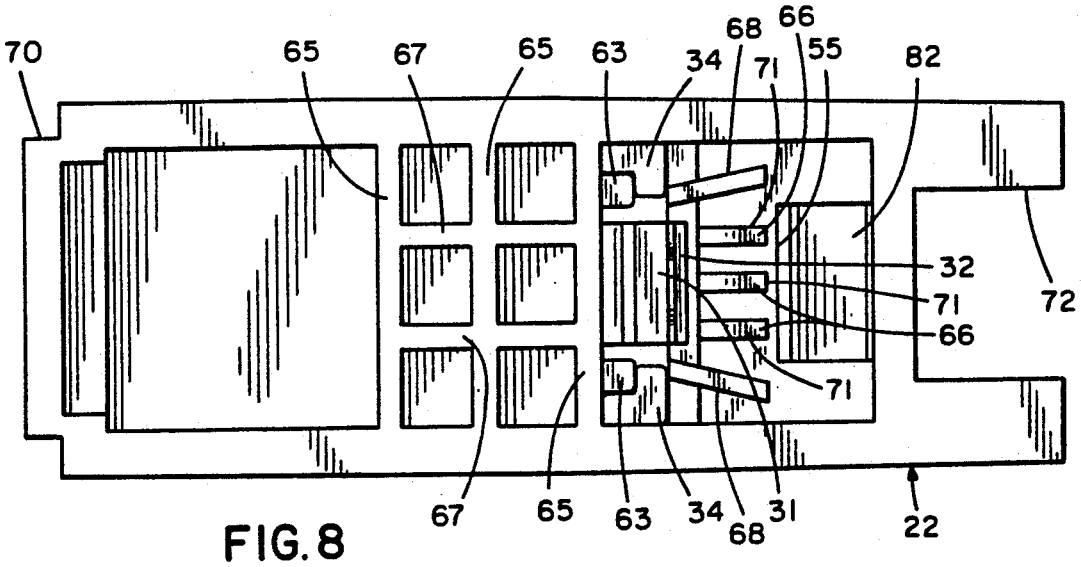
FIG. 8 is a bottom view of the telephone connector of FIG. 1.

As best seen in FIG. 8, three reinforcing walls 65 are formed extending across the width of housing 22 with four intermediate reinforcing walls 67 being formed equally spaced and perpendicular to walls 65 to form a cellular reinforcing structure disposed underneath and opposite to contacts of an assembled connector. This reinforcing structure allows compression of fixture 21 with housing 22 and contact carrier 23 by a plier tool during assembly with decreased risk of damage to connector 22.

As best seen in FIGS. 3 and 8, a screw driver guidance means for facilitating the release of central latch 31 with a screw driver for disassembly of connector 20 includes two peripheral positioning walls 68 and a plurality of screw driver guidance walls 71 positioned therebetween formed on the bottom surface of housing 22. As best seen in FIG. 3, peripheral positioning walls 68 have a rectangular profile and, as seen in FIG. 8, are angled inwardly directing a screw driver blade placed therebetween towards locking barb 32. The forward edges 66 of screw driver guidance walls 71 opposite locking barb 32, as best seen in FIG. 3, are angled towards barb 32. Thus, a screw driver positioned between peripheral positioning walls 68 and brought into contact with guidance walls 71 is guided into contact with locking barb 32 to resiliently deform barb 32 and disengage it from housing 22 allowing the disassembly of connector 20.

Figure 9:
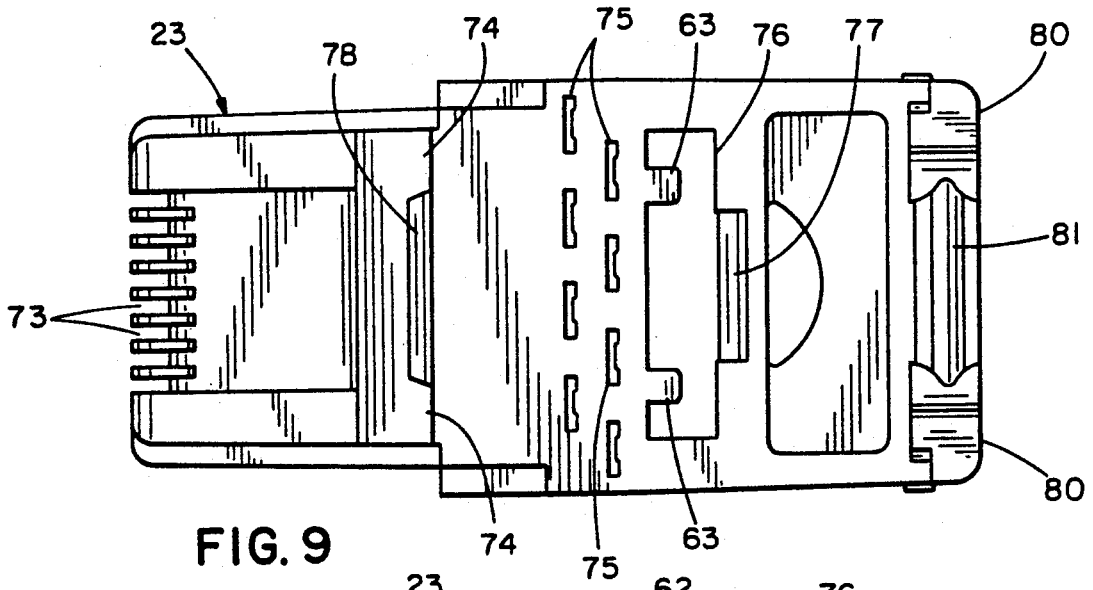
FIG. 9 is a plan of the contact carrier of the connector of FIG. 1.
Figure 10:
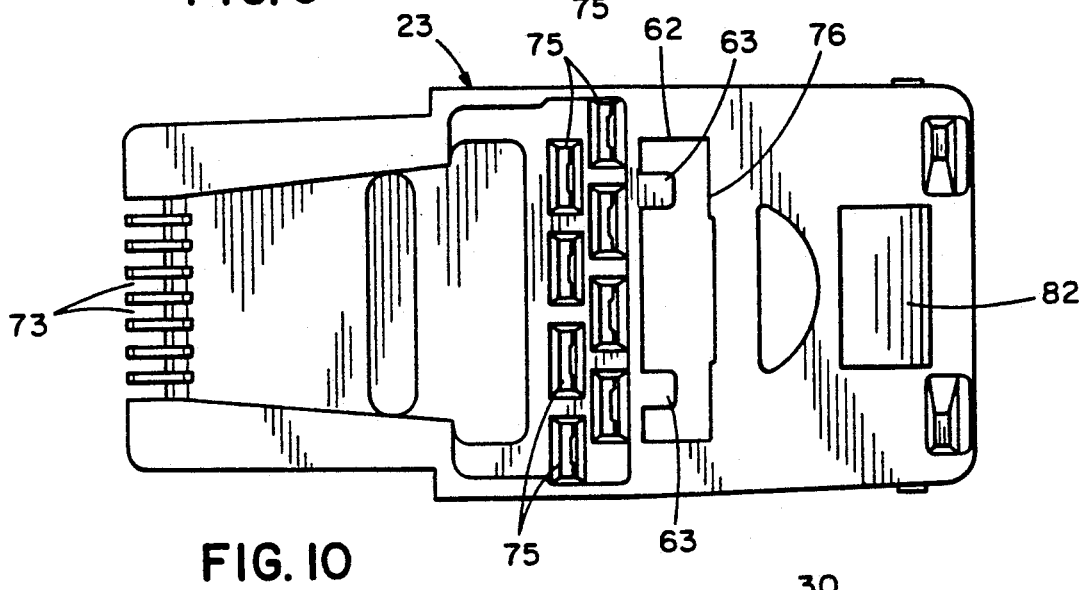
FIG. 10 is a bottom view of the contact carrier of FIG. 9.

As seen in FIGS. 9 and 10, contact carrier 23 includes a plurality of contact positioning slots 73 in an insertion end of contact carrier 23 and positioning flanges 74 (see FIG. 5) configured for receipt within slot 58 of housing 20 to accurately center contacts 24 carried on contact carrier 23 with respect to contact positioning slots 73. A plurality of contact apertures 75 are formed through the thickness of contact carrier 23 in first and second staggered rows.

A carrier alignment slot 76 is formed through the thickness of the contact carrier 23 and is disposed to align with a housing alignment slot 62 to allow insertion of central latch 31. Carrier alignment slot 76 includes splines 63 each of which mate with L shaped key columns 34 to provide fine alignment in two directions. See FIGS. 8 and 9. An angled guide surface 77 gradually directs central latch 31 into a resiliently compressed disposition as it is inserted through carrier alignment slot 76.

Contact carrier 23 includes a nonconductive contact shield 78 that projects upwardly from the upper surface of contact carrier 23. Shield 78 mates with a window 79 (see FIG. 5) formed in housing 22 and is disposed between the cantilever portions and the insulation displacement portions of contacts 24 to prevent the possibility of contact between a terminated wire and the cantilever portions of the contacts which could result in a defective assembly of a connector harness.

Cable positioning walls 80 are disposed at a rearward end of contact carrier 23 with a strain relief ridge 81 disposed therebetween. Strain relief ridge 81 and positioning walls 80 are disposed to engage the sheath of terminated telephone cable 25 to provided strain relief to an assembled connector 20. An inset contact positioning surface is formed in the bottom surface of contact carrier 23 to accept the thickness of the intermediate portion of contacts 24. As seen in FIGS. 3 and 10, a carrier latch 82 formed on the bottom rearward surface of contact carrier 23 is disposed to latch within carrier latch aperture 55 of housing 22.

As seen in FIGS. 2 and 3 contacts 24 include a resilient cantilever portion 83 for resilient engagement of the terminals of a modular telephone plug, an insulation displacement portion 84 having an insulation displacement slot 85, and an intermediate portion 86 joining cantilever portion 83 and insulation displacement portion 84. Contacts 24 are assembled to contact carrier 23 with an insulation displacement portion positioned in each contact aperture 75 forming contact rows 46 and 47 disposed in a staggered array which minimizes the overall width of the array and connector 20. Contact carrier 23 is then inserted into housing 22 until latch 82 enters aperture 55 to lock carrier 23 to housing 22.

Wires 26 are terminated to assembled housing 22, contacts 24 and contact carrier 23 of connector 20 by inserting eight individual wires of telephone cable 25 through aligned wire guide channels 35 and 48 of wire positioning fixture 21, severing the ends of wires and manipulating wire positioning fixture 21 to align central latch arm 31 and key columns 34 with slots 76 and 62 of contact carrier 23 and housing 22, and manually forcing fixture 21 into latching engagement with carrier 23 and housing 22.

The preferred embodiment of connector 20 is specially constructed to include mounting pad 70 and mounting slot 72 (see FIG. 8) so that connector 20 can be interchangeably mounted as a component in a communication box assembly described in U.S. Pat. No. 4,875,881 assigned to a common assignee, which is incorporated herein by reference, although the connector 20 of the present invention can be modified to effect a free standing configuration as taught in U.S. Pat. No. 4,975,078 assigned to a common assignee and incorporated herein by reference.

A second embodiment of a daisy chain modular telephone connector is designated by the numeral 90 in FIGS. 12–16. All of the features of daisy chain connector 90 are identical to and numbered the same as modular telephone connector 20 of FIGS. 1–11, except for the addition of a plurality of wire positioning exit slots 91 formed along the forward peripheral edge of a daisy chain wire positioning fixture 92. Exit slots 91 allow wires 26 to extend through exit slots 91 such that a second connector can be terminated to the distal portions of wires 26 allowing the construction of a "daisy chain" of connectors on wires 26.

While the particular preferred embodiments of the present invention have been shown and described, it will be obvious to those skilled in the art that changes and modifications may be made without departing from the teachings of our invention. Specifically, it should be noted that the disclosed telephone connector can be modified to terminate any number of a plurality of conductors. In addition, the insulation displacement portion 84 of contacts 24 may be arranged in a single row or in a plurality of rows either in parallel alignment or in a non-parallel configuration.

We claim:

1. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier means for mounting the contacts to the housing with the insulation displacement portions disposed outwardly of the housing arranged in a contact row on an upper surface of the contact carrier means;

fixture means for positioning the wires with respect to the insulation displacement portions, the fixture means including a plurality of wire guide channels formed in a row on an inner surface of the fixture means; and central resilient latch means integrally formed on the connector for securing the fixture means to the housing and contact carrier such that the fixture means cannot be latched to the housing and contact carrier in a misaligned disposition relative to the contacts, the central latch means being medially disposed inwardly from the periphery of the connector closely adjacent to the insulation displacement portions of the contact row and including a resilient cantilever latch arm and an opposing alignment slot, both disposed to engage with each other to secure the fixture means to the housing with the cantilever latch arm being formed on the inner surface of the fixture, projecting substantially perpendicular therefrom and with the latch arm including a locking barb formed on its distal end; with the slot being formed through the contact carrier and the housing; and including key means formed inwardly from the periphery of the connector for fine alignment of the housing and contact carrier with the fixture during assembly of the connector.

2. A telephone connector as set forth in claim 1, wherein the key means includes two cantilever key columns projecting from the inner surface of the fixture and disposed on either side of the latch arm.

3. A telephone connector as set forth in claim 2, wherein each key column has an L shaped cross section and wherein the slot includes two splines formed along its periphery and disposed to mate with each respective key column whereby the key columns are accurately positioned relative to the slot upon assembly of the connector.

4. A telephone connector as set forth in claim 3, wherein the latch arm is releasable from the slot.

5. A telephone connector as set forth in claim 4, wherein the housing and contact carrier are formed of separate parts.

6. A telephone connector a set forth in claim 5, including a nonconductive contact shield formed on the contact carrier and disposed between the first portion of the contacts and the insulation displacement portion of the contacts to prevent the possibility of contact between a terminated wire and the first portion of the contacts.

7. A telephone connector as set forth in claim 6, wherein the housing includes cellular reinforcing means for structurally reinforcing a portion of the housing disposed opposite the row of contacts of an assembled connector.

8. A telephone connector as set forth in claim 7, wherein the central latch means consists of a single latching member.

9. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier means for mounting the contacts to the housing with the insulation displacement portions disposed outwardly of the housing arranged in a contact row on an upper surface of the contact carrier means;

fixture means for positioning the wires with respect to the insulation displacement portions, the fixture means including a plurality of wire guide channels formed in a row on an inner surface of the fixture means;

central resilient latch means integrally formed on the connector for securing the fixture means to the housing and contact carrier such that the fixture means cannot be latched to the housing and contact carrier in a misaligned disposition relative to the contacts, the central latch means being medially disposed inwardly from the periphery of the connector; and screw driver guidance means formed on the bottom surface of the housing for directing a screw driver against the latch means to release the latch means from the housing and allow disassembly of the telephone connector, wherein the screw driver guidance means includes two peripheral positioning walls and a plurality of screw driver guidance walls formed between the positioning walls, and a forward edge of each of the guidance walls is angled towards the latch means.

10. A telephone connector adapted for termination of a plurality of telephone wires, comprising:

a housing adapted to mate with a standard telephone connector;

a plurality of metal contacts each having a first portion adapted to conductively engage corresponding terminals of the standard telephone connector and an insulation displacement portion adapted to terminate one of the telephone wires;

contact carrier means for mounting the contacts to the housing with the insulation displacement portions disposed outwardly of the housing arranged in a contact row on an upper surface of the contact carrier means;

fixture means for positioning the wires with respect to the insulation displacement portions, the fixture means including a plurality of wire guide channels formed in a row on an inner surface of the fixture means; and central resilient latch means integrally formed on the connector for securing the fixture means to the housing and contact carrier such that the fixture means cannot be latched to the housing and contact carrier in a misaligned disposition relative to the contacts, the central latch means being medially disposed inwardly from the periphery of the connector; wherein a plurality of exit slots are formed in a forward edge of the fixture means in respective alignment with each of the wire guide channels such that a conductor can be terminated in the connector with the distal end of the conductor extending through each exit slot for possible later termination to a second connector; wherein the central latch means is disposed closely adjacent to the insulation displacement portions of the contact row and includes a resilient cantilever latch arm and an opposing alignment slot, both disposed to engage with each other to secure the fixture means to the housing with the cantilever latch arm being formed on the inner surface of the fixture, projecting substantially perpendicular therefrom and wherein the latch arm includes a locking barb formed on its distal end; and the slot is formed through the contact carrier and the housing; and further including key means formed inwardly from the periphery of the connector for fine alignment of the housing and contact carrier with the fixture during assembly of the connector.

11. A telephone connector as set forth in claim 10, wherein the key means includes two cantilever key columns projecting from the inner surface of the fixture and disposed on either side of the latch arm.

12. A telephone connector as set forth in claim 11, wherein each key column has an L shaped cross section and wherein the slot includes two splines formed along its periphery and disposed to mate with each respective key column whereby the key columns are accurately positioned relative to the slot upon assembly of the connector.

13. A telephone connector a set forth in claim 12, including a nonconductive contact shield formed on the contact carrier and disposed between the first portion of the contacts and the insulation displacement portion of the contacts to prevent the possibility of contact between a terminated wire and the first portion of the contacts.

14. A telephone connector as set forth in claim 13, wherein the housing includes cellular reinforcing means for structurally reinforcing a portion of the housing disposed opposite the row of contacts of an assembled connector.

15. A telephone connector as set forth in claim 14. including screw driver guidance means formed on the bottom surface of the housing for directing a screw driver against the latch means to release the latch means from the housing and allow disassembly of the telephone connector.

16. A telephone connector as set forth in claim 15, wherein the screw driver guidance means includes two peripheral positioning walls and a plurality of screw driver guidance walls formed between the positioning walls, wherein a forward edge of each of the guidance walls is angled towards the latch means.

* * * * *